United States Patent [19]

Rayhle

[11] Patent Number: 4,765,457

[45] Date of Patent: Aug. 23, 1988

[54] PAINT BOX

[75] Inventor: Claus Rayhle, Stuttgart, Fed. Rep. of Germany

[73] Assignee: Pelikan Aktiengesellschaft, Hanover, Fed. Rep. of Germany

[21] Appl. No.: 7,687

[22] Filed: Jan. 28, 1987

[30] Foreign Application Priority Data

May 24, 1986 [DE] Fed. Rep. of Germany ..... 8614126

[51] Int. Cl.[4] ..... B44D 3/04

[52] U.S. Cl. ..... 206/1.8; 206/1.7; 206/1.5; 206/372

[58] Field of Search ..... 206/1.7, 1.8, 315.11, 206/372, 349, 361, 1.5; 312/244, DIG. 33

[56] References Cited

U.S. PATENT DOCUMENTS

| | | | |
|---|---|---|---|
| 2,264,744 | 12/1941 | Dunnam | 312/244 X |
| 2,723,484 | 11/1955 | Nelson, Jr. | 206/315.11 X |
| 3,350,810 | 11/1967 | Warner et al. | 206/315.11 X |
| 3,414,343 | 12/1968 | Thomas | 206/1.7 X |
| 3,533,618 | 12/1950 | Pinaski | 206/1.8 |
| 3,595,433 | 7/1971 | Jones | 220/339 X |
| 3,606,511 | 9/1971 | Henning et al. | 206/315.11 X |
| 4,372,630 | 2/1983 | Fuhri | 206/1.7 X |

FOREIGN PATENT DOCUMENTS

| | | | |
|---|---|---|---|
| 642137 | 5/1964 | Belgium | 206/1.7 |
| 85137 | 8/1983 | European Pat. Off. | 206/1.7 |
| 601664 | 8/1934 | Fed. Rep. of Germany | 206/1.8 |
| 2152387 | 4/1976 | Fed. Rep. of Germany . | |
| 8336355 | 8/1984 | Fed. Rep. of Germany . | |
| 2401592 | 4/1979 | France | 206/1.7 |
| 1513687 | 6/1978 | United Kingdom | 206/1.8 |

*Primary Examiner*—Stephen Marcus
*Assistant Examiner*—T. Graveline
*Attorney, Agent, or Firm*—Herbert Dubno; Ronald Lianides

[57] ABSTRACT

At least two trays are positioned over each other which are lockable by a cover. One of the trays is a drawer which is lockable in an inserted position with the cover. The paint box can have an upper and a lower tray and the upper tray can comprise a rectangular housing with a foldable cover. The rectangular housing has double side walls extending downwardly and forming a guide for the lower tray which is the drawer. The undersurface of the drawer can form the supporting surface for the housing while the upper tray housing rests on the drawer. The double side walls of the rectangular housing end with a small space above the bottom plane of the drawer and the inserted edge of the drawer can be lowered an amount corresponding to that small space. The pulled out end of the drawer can have a strap which projects upwardly over the upper tray and engages under the edge of the foldable cover. The strap can be resilient and have a laterally projecting lip which locks in a groove in the edge of the foldable cover transverse to the opening direction of the foldable cover.

4 Claims, 2 Drawing Sheets

PAINT BOX

FIELD OF THE INVENTION

My present invention relates to a container with at least two paint trays positioned one above the other and, more particularly, to a paint box with two paint trays and a water receptacle for watercolors, aquatints and the like.

BACKGROUND OF THE INVENTION

A known paint box comprising a cup shaped bottom container closable by a cover is described in German Open Patent Application DE-OS No. 21 52 387. A plurality of palettes stacked over each other which contain the pigment cups or mixed color trays are placed in the pot shaped bottom container.

The bottom container can act as a water storage vessel after removal of the palettes.

This known paint box is understandably inconvenient and troublesome to manipulate since the lower palettes are only accessible after the palettes over them have been removed.

Furthermore the structure of this known paint box does not allow the storage of paint brushes and other painting accessories which may be of great length. Also the height of the known paint box which results from several palettes stacked over each other makes the unit inconvenient for storage.

The paint box described in German Utility Model DE-OS No. 83 36 355.6 comprises two substantially equal size tray-like covers which are attached at their adjacent short sides by hinges with a central member which acts as a water container.

Several compartments are formed in the covers in which pigment cups are placed.

For closing this known paint box the tray-like covers are foldable onto one another. They are held in the closed position by edge strips engaged in each other.

With this known paint box it is disadvantageous that in the closed position the pigment cups positioned in the upper cover suspended downwardly are placed over the pigment cups in the lower cover member. Special precautions must be taken to prevent the dropping of pigment from the pigment cups when they are disposed one above another.

OBJECTS OF THE INVENTION

It is an object of my invention to provide an improved container, especially a paint box, avoiding these drawbacks.

It is another object of my invention to provide an improved highly compact paint box having a plurality of trays which permits a separate accessibility to the trays and the pigment cups and an upright storage of the contents of the trays.

It is a further object of my invention to provide an improved paint box which is especially easy to use and in which the colors from the individual pigment cups can not be inadvertently mixed when the paint box is closed, and yet the paint box is not so large that it is difficult to store in a school bag.

SUMMARY OF THE INVENTION

These objects and others which will become more readily apparent hereinafter are attained in accordance with my invention in a container, especially a paint box, having at least two trays positioned one over the other which are lockable by a cover, one of the trays being a drawer which is lockable in its inserted position by the cover.

The container of my invention has the advantage that after opening the cover both trays are equally accessible without having to remove inserts or palettes from the container.

Furthermore both trays are completely separate from each other so that their contents are not in contact with each other. Thus undesired mixing of colors is avoided when this container is used as a paint box.

On locking the cover the drawer is fixed in its pushed in position so that the paint box is closed securely for transport.

The structure of the paint box according to my invention gives a desirable container shape, for example a rectangular parallelepiped which can be made with simple means.

Advantageously according to my invention the paint box has an upper and a lower compartmentalized tray and the upper tray comprises a rectangular housing with a foldable cover. The rectangular housing has double side walls extending downwardly and forming a guide for the lower tray which is the drawer.

It is especially advantageous when the under surface of the drawer forms the supporting surface for the housing while the upper tray housing rests on the drawer.

This has special benefits in use of the paint box since in this way the upper tray can be pushed back from the paint or sketch pad on opening the pigment box while the lower tray remains in place. Thus the opening motion of the paint box is not prevented by the paint pad or paper.

To be able to completely pull out and push in easily the drawer in the paint box according to a further feature of my invention the double side walls of the rectangular housing end at a small distance above the bottom plane of the drawer and the inserted edge of the drawer is dropped by an amount corresponding to that small distance. Thus both parts can be pulled from each other or again pushed together easily on an upwardly facing surface.

To secure the drawer in its inserted position in the closed paint box the drawer has a flap or strap which projects upwardly over the upper box and engages under the edge of the foldable cover. This feature of the drawer is easily manufactured. Further the strap acts as a handle with which the drawer can be easily pulled out. Another advantageous feature of my invention is provided when the strap is resilient and has a laterally projecting lip which locks in a groove formed in an inner surface of the edge of the foldable cover transverse to the opening direction of the foldable cover. In this way the strap simultaneously forms a latch or snap lock for securing the cover in the closed position.

For attachment of the cover to the housing according to my invention the foldable cover is formed with a first flexible lug at either end thereof at a rear wall of the housing, each first lug being engageable by a respective pin held in a respective second lug formed on the rear wall of the housing and spaced from the first lug, so that a user can insert a finger between pairs of first and second lugs for deforming the first lugs outwardly to release the cover from the pins for cleaning the cover.

On one of the lateral walls of the housing a plurality of guide strips directed vertically are provided on which a water container with a recessed guide groove is insertable from above. Thus the water container is attached with the paint box detachably in an easy way and its stability in use is improved.

The opening cross section of the water container corresponds advantageously to the lateral cross section of the closed paint box. Therefore the water container can be pushed on the paint box so that no additional space is required. Moreover the paint box is secured additionally in the closed position.

According to a further feature of my invention the lateral cross section of the paint box and the opening cross section of the water container are substantially equal and asymmetric. The water container is thus pushed on the lateral wall of the paint box which carries the guide strips. Thus by the asymmetry the water container is only mountable on the lateral wall of the paint box so that the water container pushed on the paint box always covers or encloses the guide strips. In storing the paint box the guide strips on the outer surface thus do not catch other articles or cause a disturbance.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
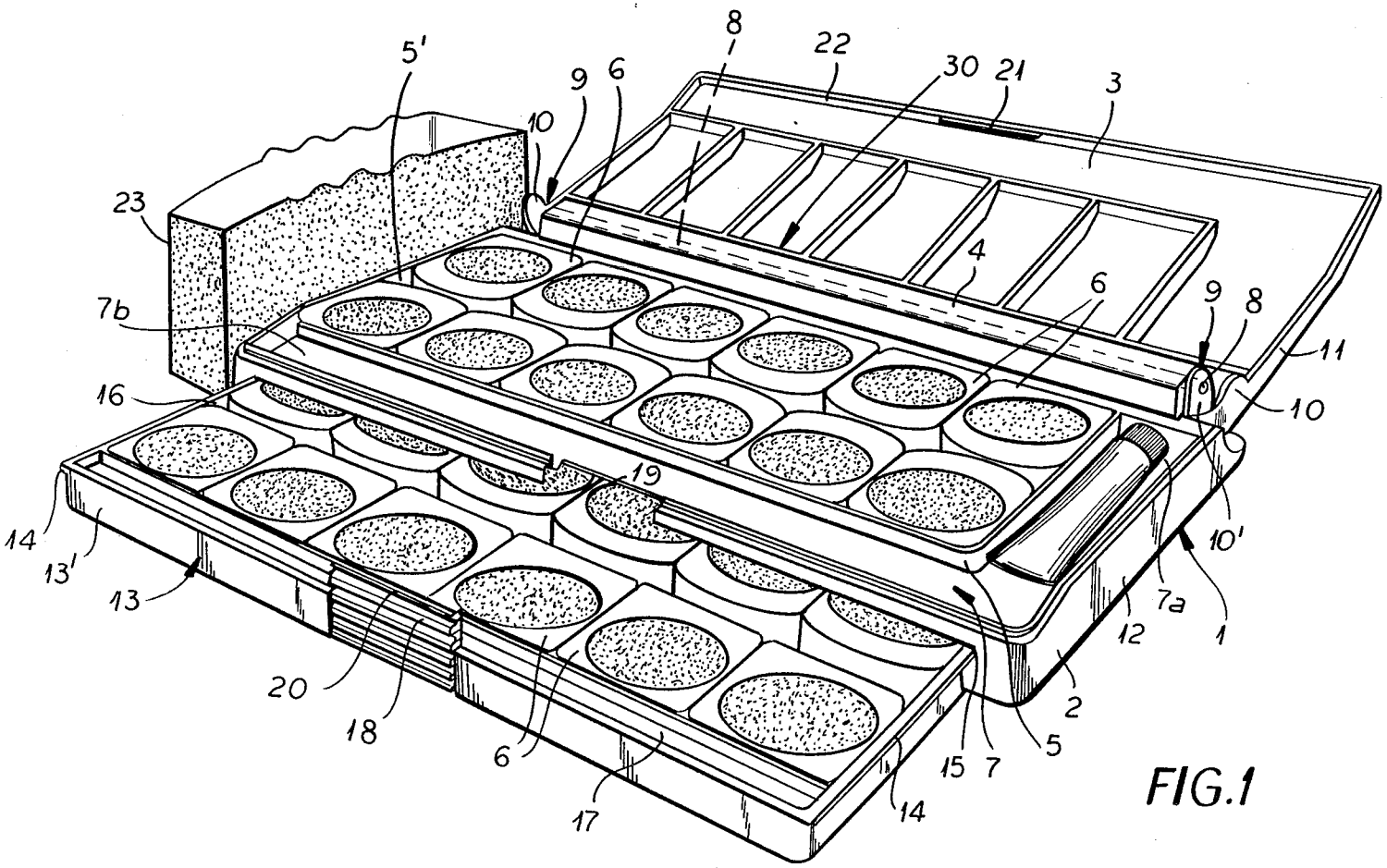
FIG. 1 is a perspective view of a paint box according to my invention shown open with an attached lateral water container.

The paint box shown in the drawing comprises a comparatively flat approximately quadralateral upper tray 2 with a foldable cover 3 which is pivotally mounted at the corners of a longitudinal side 4.

The upper tray 2 has a rectangular partition 5 defining a rectancular compartment 5' in which individual pigment cups 6 of different colors are placed. An L-shaped compartment 7 borders the partition 5 and has a shorter segment *7a* provided for receiving pigment tubes, for example a white cover pigment, and whose longer segment *7b* can be used for brushes and other painting accessories.

At the ends of the longitudinal side 4 of the cover 3 projecting pins 8 formed by a bar shaped segment mounted by lugs 10' on the tray 2 are provided for mounting the foldable cover 3. These pins 8 engage in a mounting hole provided in lugs 10 of the foldable cover 3. The lugs 10 lie flush with the lateral surfaces 11 of the foldable cover 3 and are elastically deflectable. Both lugs of each mounting set 9 (i.e. lugs 10', 10) are spaced apart from one another. This structure for mounting the cover 3 allows engagement of ones fingers between the lugs 10' and 10 and deformation of the lugs 10 to the outside by pressure to lift it in this way from the pins 8 engaged by the lugs 10'.

By these simple manipulations the foldable cover 3 can be removed from the upper tray 2 and separated from it for cleaning. The pigment cups 6 present in the upper tray compartment 5' are thus not sprayed with water during cleaning of the foldable cover 3. The subsequent mounting of the foldable cover 3 on the upper tray 2 is similarly possible in an easy way simply by putting the foldable cover 3 back on the way it was removed. The pins 8 automatically lock in the mounting holes in the lugs 10. Thus a hinge 30 comprising the mounting sets 9 and the pins 8 is formed.

Double walls 12 are provided at the lateral sides of the upper tray 2, the inner ones of of the walls 12 which extend out over a lower portion of the base of the upper tray 2 and form a wide receptacle in which a substantially rectangular lower tray 13 comprising a drawer 13' is inserted.

The drawer 13' is provided with a guide strip 14 on its opposing lateral surfaces which engage in a guide groove 15 formed in each inside one of the double walls 12.

The tray 13 has a large compartment 16 in which likewise pigment cups 6 of different colors are placed and a small compartment 17 for receiving brushes and other painting accessories.

On the front of the tray 13 a resilient strap or fastener 18 is provided which engages in a recess 19 in the front of the upper tray compartment 2 when the drawer 13 is closed and whose upper laterally projecting lip 20 together with a groove 21 on the inside of the peripheral edge 22 of the foldable cover 3 form a snap lock by which the foldable cover 3 is held in the closed position.

The height of the tray 13 is slightly greater than the height of the double walls 12 so that the tray 13 projects below the upper tray 2, which is supported on the tray 13, which in turn rests on the undersurface 13*a* thereof.

Thus on setting up and opening the paint box the upper tray 2 may rest on the tray 13. The drawer 13' therefore can be brought into a working position by displacing the tray 2 rearwardly.

Figure 2:
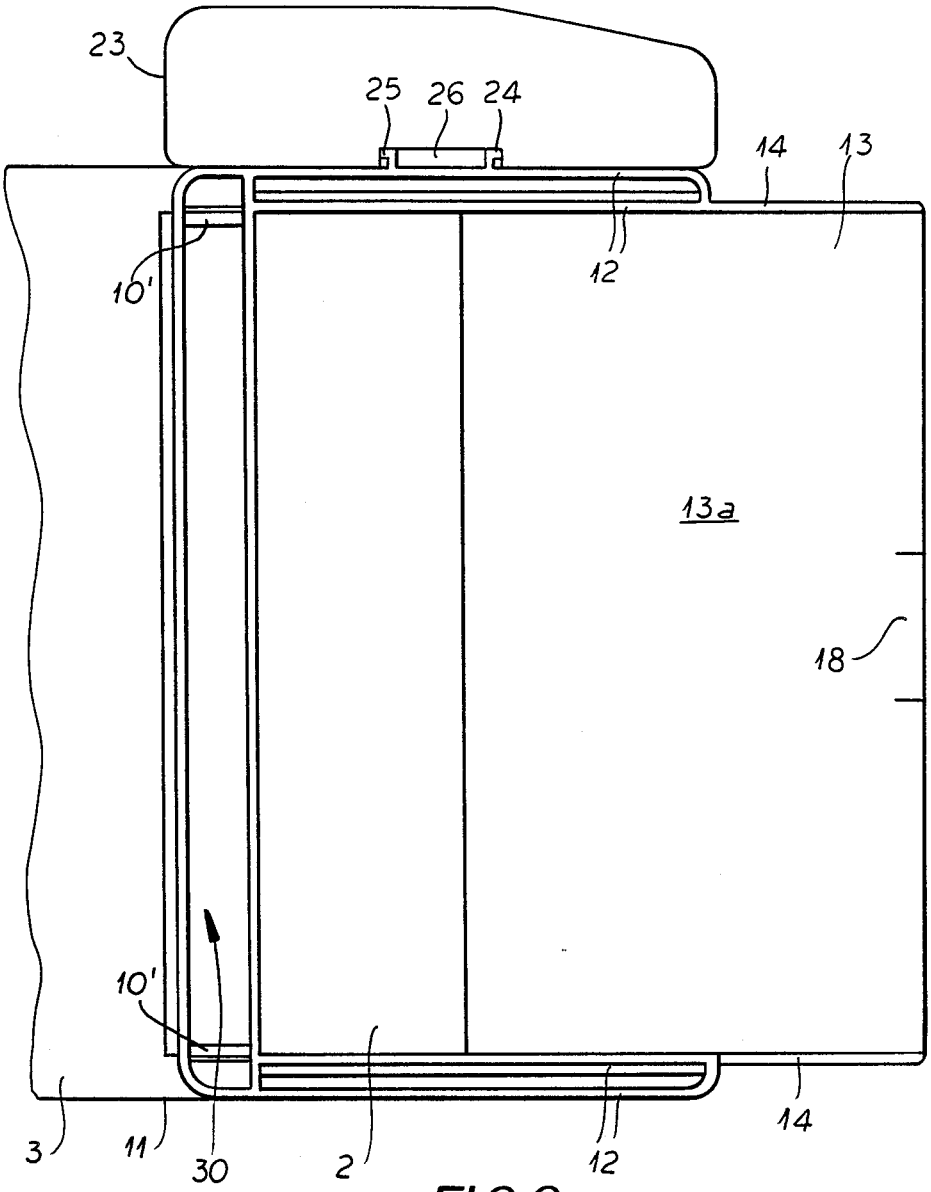
FIG. 2 is a bottom plan view of the paint box of FIG. 1.
Figure 3:
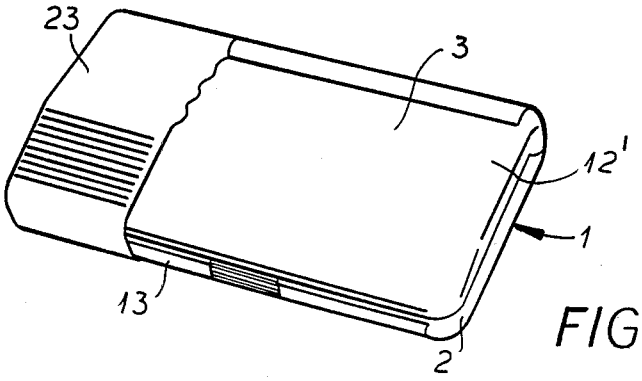
FIG. 3 is a reduced perspective view of the paint box of FIG. 1 shown closed with its water container in its storage position.

When the pigment cups 6 contain water soluble pigments, for example opaque pigments or water colors, the paint box 1 is additionally provided with a water container 23. The water container 23 is removably attached to a side wall 12 of the upper tray 2. Here the side wall 12 of the upper tray 2 as seen in FIG. 2 has two L-shaped guide strips 24,25 which engage in a corresponding shaped undercut guide groove 26. The water container 23 is thus held upright by the paint box 1 during use. Its stability is substantially increased.

The open cross section of the hollow space of the water container 23 is equal to or similar enough to the lateral cross section of the paint box 1 at the lateral walls 12 of the container 1 so that the water container 23 can be pushed on an end of the closed paint box 1 when the paint box is not in use. Then the assembly does not require additional space. Further the paint box 1 is held by the pushed on water container 23 additionally in the closed position.

I claim:

1. A paint box comprising:

an elongated housing forming an upper tray formed with a plurality of compartments for holding paints and accessories, respective inner and outer side walls being formed at the ends of said housing, the inner side walls delimiting a cutout formed in a front wall of said housing, the inner side walls each being formed with a guide groove and defining a receptacle;

an elongated lower tray forming a drawer formed with a plurality of compartments for holding paint and accessories, opposing side walls at the ends of said drawer being provided with respective guide strips engageable in said guide grooves and said drawer being receivable in said receptacle, a lower surface of said drawer projecting below said housing, whereby said housing is supported on said drawer;

an elongated cover pivotally mounted at a rear wall of said housing and adapted to overlie said housing in a closed position of said cover;

a flexible fastener formed at a front side of said drawer and engageable with said cover in said closed position thereof; and a water container mountable at a side of said housing and configured to fit over one of said ends of said paint box in a closed position thereof.

2. The paint box defined in claim 1 wherein said cover is formed with a first flexible lug at either end thereof at the rear wall of said housing, each first lug being engageable by a respective pin held in a respective second lug formed on the rear wall of said housing and spaced from the first lug, whereby a user can insert a finger between pairs of first and second lugs for deforming the first lugs outwardly to release said cover from said pins.

3. The paint box defined in claim 1 wherein the outline taken from an end of said paint box in the closed position thereof is asymmetrical, whereby said water container can only be fitted over one of the ends of said paint box.

4. The paint box defined in claim 1 wherein said flexible fastener is an upright strap formed with an outwardly directed projection at an upper free end thereof and said cover is formed with a groove in the inner surface of a front wall thereof and engageable with said outwardly directed projection in the closed position of said cover, whereby said closed cover can be released by pressing inwardly on said strap to disengage said projection and groove.

* * * * *